United States Patent [19]

Yokoyama

[11] Patent Number: 4,908,009

[45] Date of Patent: Mar. 13, 1990

[54] CORNER-FORMING UNIT OF A CARTON CONTAINER-FORMING MACHINE

[75] Inventor: Yoshimitsu Yokoyama, Ishikawa, Japan

[73] Assignee: Milliken Research Corporation, Spartanburg, S.C.

[21] Appl. No.: 274,851

[22] Filed: Nov. 22, 1988

[51] Int. Cl.[4] ..... B31B 1/36; B65H 45/22

[52] U.S. Cl. ..... 493/178; 493/248; 493/255; 493/295; 493/310; 493/408; 493/439

[58] Field of Search ..... 493/178, 181, 248, 254, 493/255, 295, 302, 310, 408, 439, 440, 443

[56] References Cited

U.S. PATENT DOCUMENTS

| | | | |
|---|---|---|---|
| 3,400,033 | 9/1968 | Galimberti | 493/309 |
| 3,774,509 | 11/1973 | Heinzer | 493/252 |
| 3,795,359 | 3/1974 | Rausing | 229/7 R |
| 3,812,644 | 5/1974 | Kamikawa et al. | 53/29 |
| 3,903,672 | 9/1975 | Goglio | 53/24 |
| 3,910,171 | 10/1975 | Reinhardt et al. | 493/295 |
| 4,260,446 | 4/1981 | Saul | 493/295 |
| 4,267,957 | 5/1981 | Holmstrom | 229/37 R |
| 4,349,344 | 9/1982 | Evers | 493/11 |
| 4,510,732 | 4/1985 | Lothman | 53/168 |
| 4,546,592 | 10/1985 | Reil | 53/373 |
| 4,578,051 | 3/1986 | Everman | 493/439 |
| 4,614,079 | 9/1986 | Ida et al. | 53/563 |

FOREIGN PATENT DOCUMENTS

| | | | |
|---|---|---|---|
| 827581 | 7/1949 | Fed. Rep. of Germany | 493/248 |

*Primary Examiner*—William Terrell

*Attorney, Agent, or Firm*—Earle R. Marden; H. William Petry

[57] ABSTRACT

A corner forming unit of a package forming machine which employs an H-shaped guide over which the packaging material passes after it has been longitudinally sealed. A pair of rollers outside of the tube of material forms the edges of the packaging material into the H-shaped guide to form the corners of the material from which individual filled rectangular packages will be formed.

1 Claim, 2 Drawing Sheets

CORNER-FORMING UNIT OF A CARTON CONTAINER-FORMING MACHINE

DETAILED EXPLANATION OF THE INVENTION APPLICATION FIELD OF INDUSTRY

This design concerns a corner-forming unit for forming beautiful side corner portions of a parallelepiped carbon container formed on a carton container-forming machine that can continuously form parallelepiped carton containers from a roll of machine-glazed paper having synthetic resin film on the paper surface, with the containers filled with content during the forming process.

CONVENTIONAL TECHNIQUES

The forming process from machine-glazed paper having synthetic resin film on it to the parallelepiped carton container include the following stages: a printing stage in which the pattern of each carton container is printed on the machine-glazed paper, a stamping stage in which the folding lines for forming the desired parallelepiped container are stamped on the paper, a hygiene treatment stage, a longitudinal sealing stage for forming a tubelike part, a cutting stage in which the tubelike part is cut in the length required by each carton container, an insertion stage in which the cut-off cylinder is set on a mandrel, a sealing stage in which the bottom or top of the cylinder set on the mandrel is formed and sealed, a filling stage in which the content is filled into the container removed from the mandrel, and another sealing stage in which the top or bottom of the container is formed and sealed. In this way, a parallelepiped carton container is finally formed.

Hence, formation of neat corners on the side surfaces of the carton container is related to stamping in the stamping stage, folding of the stamped portions after setting on the mandrel, and formation of the bottom and top sides of the container.

PROBLEMS TO BE SOLVED BY THE DESIGN

In the above-mentioned conventional process, there is no stage for forming the next corners on the side surfaces of the carton container.

In the stamping stage, the locations to be folded are determined, and folding is made easier by stamping. In addition, opening [of the tubelike part] is made easier when [the tubelike part] is to be set on the mandrel. However, there are no more effects. Although during the process the corner portions can be folded by a force up to 90°, no active corner formation above 90° is performed.

As the folding degree of the corner portions is insufficient, when the content (particularly juice or other liquid) is filled in, it presses outward on the side walls; hence, the corner portions may be opened, resulting in a distorted container shape and a poor appearance. In this case, the commercial value of the carton container will be decreased.

This design provides a method to make corners on the side surfaces by force during the forming process. In this way, the correct and neat shape of the container can be well maintained, and the commercial value can be increased.

Figure 1:
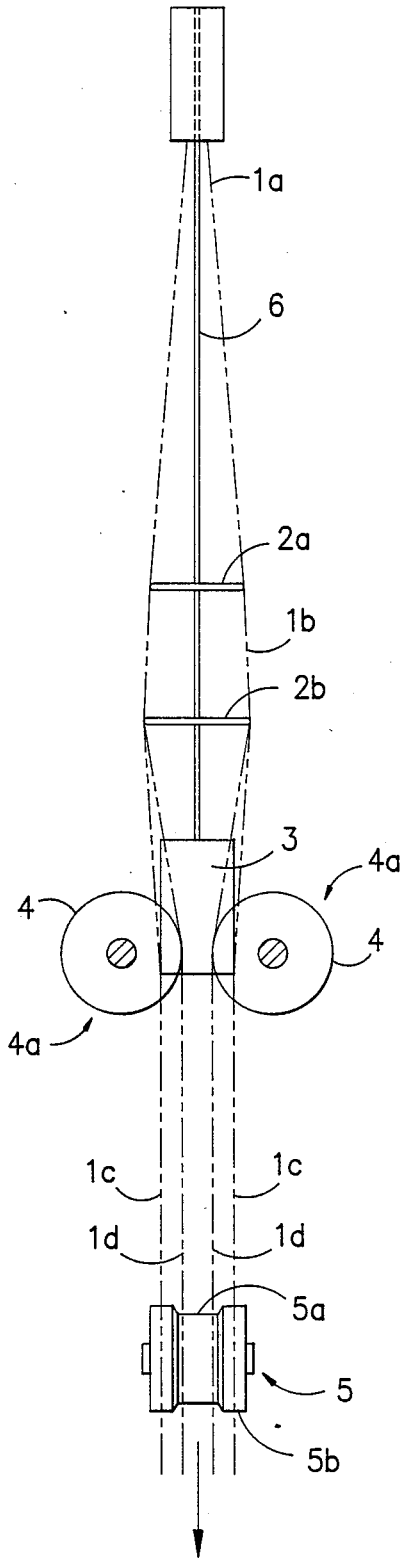
FIG. 1 is a front view of an application example of this design.

(1) tubelike part
(2) guide for expanding
(3) H-shaped guide for forming
(4) folding roller
(4*a*) outer circumferential portion
(5) corner-forming roller
(7) opening portion

METHOD TO SOLVE THE PROBLEM

According to this design, the corner-forming unit has the following features. After the longitudinal sealing stages of tubelike part (1), guide (2) for expanding, and H-shaped guide (3) for forming are arranged on the transportation line. On the outer circumferential portions (4*a*) and (4*a*) of tubelike part (1), folding rollers (4) and (4) are arranged corresponding to opening portions (7) and (7) of H-shaped forming guide (3) and entering opening portions (7) and (7) of H-shaped forming guide (3). In addition, corner-forming rollers (5) and (5) are arranged to clamp two side ends (1*c*) and (2*c*) of tubelike part (1).

FUNCTIONS

The tubelike part made from the machine-glazed paper by longitudinal sealing is transported with appropriate tensions by various driving portions.

Figure 3:
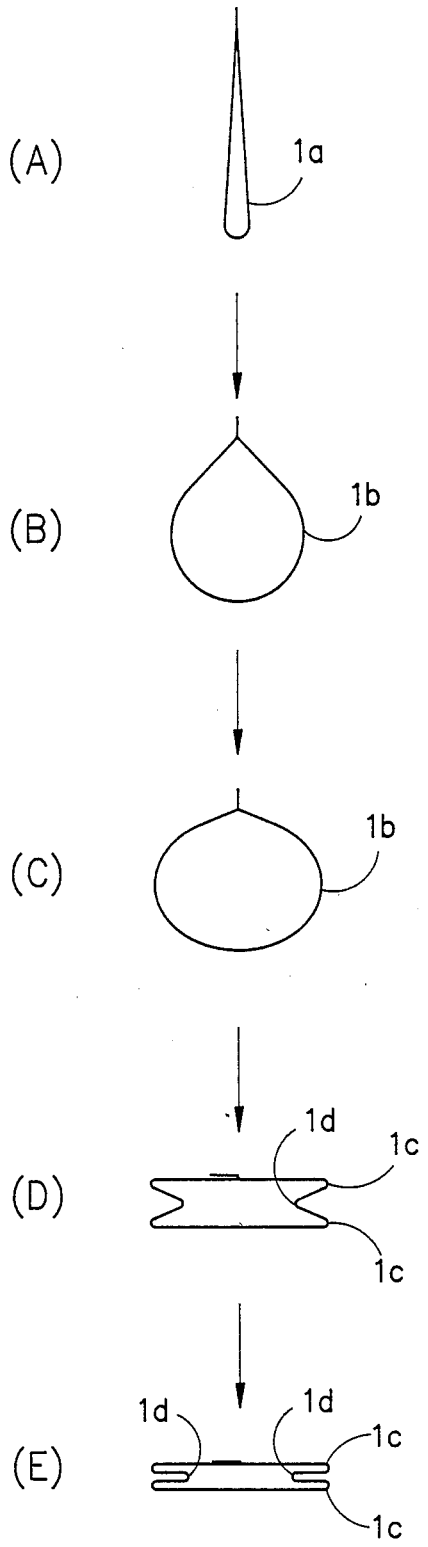
FIG. 3 is a top view showing the forming process of the tubelike part.

For this purpose, tubelike part (1) is transported in a flat shape (FIG. 3(A)). A guide for expanding (2) is located on the transporting line. Tubelike part (1) then enclosed the guide for expanding (2) while moving forward; hence, tubelike body (1) is expanded from the original flat shape to an opening shape by guide for expanding (2) (FIGS. 3(B) and 3(C)).

Tubelike part (1) expanded by guide for expanding (2) is moved to H-shaped guide (3) for forming. Corresponding to opening portions (7) and (7) of H-shaped forming guide (3), folding rollers (4) and (4) press on expanded tubelike part (1). In this way, outer circumferential portions (4*a*) and (4*a*) are folded into opening portions (7) and (7).

Tubelike part (1) is gradually pressed by folding rollers (4) and (4). In this way, it is forced to take the shape of H-shaped forming guide (3). At the same time, under the action of transportation tension, after passing through folding rollers (4) and (4), central portions (1*d*) of a pair of opposite surfaces of the cross-sectional square are folded to the inner side and take collapsed shapes (FIG. 3(D)). Then, it is clamped by the following corner-forming rollers (5) and (5) (FIG. 3(E)).

As corner-forming rollers (5) and (5), only two end portions (1*c*) and (1*c*) of tubelike part (1) are clamped; central portions (1*d*) folded inward are not clamped and hence are not formed to corners.

In this way, the corners on the side surfaces of the carton container of tubelike part (1) are folded and clamped.

APPLICATION EXAMPLE

Figure 2:
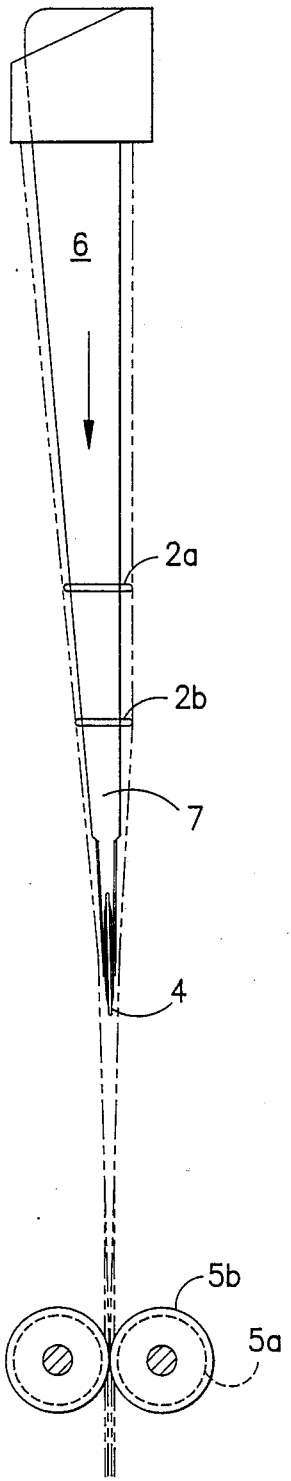
FIG. 2 is its side view.

FIGS. 1 and 2 show the front view and side view of an application example of this design, respectively. Tubelike part (1) formed by longitudinal sealing is transported from the upper side to the lower side. A guide for expanding (2), an H-shaped guide for forming (3), folding rollers (4) and (4), and corner forming rollers (5) and (5) are arranged in sequence along the transportation line.

Guide for expanding (2) and H-shaped forming guide (3) are fixed on a core part (6). Core part (6) is suspended in a position to insert into tubelike part (1) under transportation. In this way, guide for expanding (2) [is inserted into] tubelike part (1) during transportation and forms it from original flat shape (1*a*) to expand tubelike shape (1*b*).

Guide for expanding (2) is made of guide plates (2*a*) and (2*b*) that are separated by a certain distance from each other in the vertical direction and have elliptical outer circumferences.

Guide plates (2*a*) and (2*b*) have their positions and shapes determined by the requirement of gradual expansion of tubelike part (1). If needed, they can be added or reduced in number.

H-shaped forming guide (3) has a cross section in an H-shape, with opening portions (7) and (7) in a taper shape.

Corresponding to H-shaped opening portions (7) and (7), folding rollers (4) and (4) are arranged so that the outer circumferential portions (4*a*) and (4*a*) of the roller surfaces press into H-shaped opening portions (7) and (7) so that the passing expanded tubelike part is pressed. Tubelike part (1) is clamped on H-shaped forming guide (3). Folding edges are formed on tubelike part (1) by the upper and lower ends of the H-shaped parallel portion. A pair of opposite surfaces are folded inward at central portions (1*d*), forming a collapsed shape.

For corner-forming rollers (5) and (5), recessed portion (5*a*) exists on the central portion of the roller surface; only two end portions (5*b*) and (5*b*) are shaped to make contact with each other. For above-mentioned tubelike part (1) with folded collapsed central portions (1*d*) on a pair of opposite surfaces, two side end portions (1*c*) and (1*c*) that will form the corner portions of the carton are clamped, while folded central portions (1*d*) are not clamped to avoid forming folding edges in these portions.

EFFECTS OF THE DESIGN

As explained in the above, according to this design, flat tubelike part (1) is expanded using guide for expanding (2). Then, with the aid of H-shaped forming guide (3) and folding rollers (4) and (4), folding edges that will become the corner portions on the side surfaces of the carton container are formed. Corner-forming rollers (5) only forcibly clamp the corner portions to form clear folding lines; they do not clamp the central portions of the pair of opposite side surfaces. In this way, inward folding edges can be avoided at these portions while neatly creased edge folds are provided for the carton.

In this way, corner portions can be formed reliably, and the corners become very neat. On the other hand, folding patterns are left on the central portions of the pair of opposite side surfaces. Hence, when the content is filled, this folded pattern can resist the outward pressure of the content and keep the ideal shape of the container.

I claim:

1. Method to form corners on a web of material to be made into individual cartons comprising the steps of: supplying a flat, longitudinally sealed web of material, expanding the web of material into tube-like shape, forming the tube-like shape having opposed small sides each extending between a pair of corners into a rectangular shape while simultaneously pressing the small sides of the rectangle inward towards one another to form each small side into a v-shape with an inwardly extending apex, and clamping the outer portions of the rectangular shaped web of material to press the corners of each pair together without clamping the apices of the v's formed in the sides of the web, thereby creasing each of the corners of the web of material, whereby neatly creased folded edges are provided for said individual cartons.

* * * * *